United States Patent [19]

Nussbaumer et al.

[11] Patent Number: 4,673,316

[45] Date of Patent: Jun. 16, 1987

[54] METHOD FOR FABRICATING SLOTTED WALLS WITH BUILT-IN THIN-WALLED SEALING ELEMENTS

[75] Inventors: Manfred Nussbaumer, Leonberg; Eberhard Gläser, Aichwald; Eberhard Beitinger, Stuttgart, all of Fed. Rep. of Germany

[73] Assignee: Ed. Züblin Aktiengesellschaft, Stuttgart-Mohringen, Fed. Rep. of Germany

[21] Appl. No.: 806,109

[22] Filed: Dec. 6, 1985

[30] Foreign Application Priority Data

Dec. 7, 1984 [DE] Fed. Rep. of Germany ..... 3444681

[51] Int. Cl.[4] ..... E02D 5/20

[52] U.S. Cl. ..... 405/267; 405/258

[58] Field of Search ..... 405/36, 38, 43, 50, 405/52, 71, 109, 248, 258, 266, 267, 270, 274, 278–281

[56] References Cited

U.S. PATENT DOCUMENTS

| | | | |
|---|---|---|---|
| 3,422,627 | 1/1969 | Courte | 405/267 |
| 3,759,044 | 9/1973 | Caron et al. | 405/267 |
| 4,484,835 | 11/1984 | Van Klinken | 405/270 X |
| 4,519,729 | 5/1985 | Clarke | 405/258 |

FOREIGN PATENT DOCUMENTS

| | | | |
|---|---|---|---|
| 2138123 | 2/1973 | Fed. Rep. of Germany | 405/109 |
| 209010 | 4/1984 | Fed. Rep. of Germany | 405/270 |
| 8300596 | 9/1984 | Netherlands | 405/281 |
| 84/03315 | 8/1984 | World Int. Prop. O. | 405/270 |
| 2136861 | 9/1984 | United Kingdom | 405/52 |
| 705056 | 12/1979 | U.S.S.R. | 405/109 |

*Primary Examiner*—Cornelius J. Husar
*Assistant Examiner*—Nancy J. Stodola
*Attorney, Agent, or Firm*—Kenyon & Kenyon

[57] ABSTRACT

A method for installing thin-walled sealing elements in the fabrication of slotted walls in the soil. The thin-walled sealing elements are plastic foils with vertical connecting elements at the vertical edges. A connecting slot is flushed out between a newly made slotted-wall section and the interior of the adjacent slotted connecting tube of the previously installed sealing element. The slot and the interior of the connecting tube are filled with a support suspension. Then a new sealing element is threaded through the filled connecting slot into the previously installed connecting tube.

13 Claims, 6 Drawing Figures

METHOD FOR FABRICATING SLOTTED WALLS WITH BUILT-IN THIN-WALLED SEALING ELEMENTS

BACKGROUND OF THE INVENTION

The invention relates to a method for fabricating, in slots in the soil, walls with built-in thin-walled sealing elements.

If the tightness of walls built in slots in the soil is to be increased, the installation of additional planar sealing elements into the slotted wall mass is advisable. Particularly in the field of sealing depositories against the escape of leakage water containing hazardous material, stringent requirements must be met as to the barrier effect of the sealing walls. This sealing effect is achieved as a rule by the installation of planar sealing elements, preferably of plastic, with appropriate connections of the sealing elements to each other. For the installation of such sealing elements, various technical solutions have been proposed which work essentially with a cleaning tube. It is an object of the invention to provide a method which corresponds to the specific fabrication methods of the slotted wall, does not need a cleaning tube and in addition, can be employed economically.

SUMMARY OF THE INVENTION

A method in accordance with the present invention is essentially based on the following process steps:

(a) excavating or milling a suspension-supported slotted wall section with overlap toward an adjacent, pre-existing slotted wall section;

(b) flushing clear a continuous connection slot between the interior of a slotted connecting tube of a sealing element built into the pre-existing slotted wall section and the support suspension of the newly formed slotted wall section;

(c) placing a sealing element in the newly formed slotted wall section in part by introducing a plug connection into the slotted connecting tube of the sealing element of the pre-existing slotted wall section;

(d) exchanging the support suspension in the newly formed slotted wall section for hardened slotted wall mass (two-phase system) or hardening of the support suspension by the advance addition of a solidification agent (one-phase system); and (e) upon sufficient hardening of the slotted wall mass, excavating or milling the next adjacent suspension-supported slotted wall section with overlap toward the newly formed slotted wall section.

Advantageously the flushing of the connection slot can be implemented by a high-pressure jet of a suspension of water, bentonite and a solidification agent. For positioning the sealing elements, for example, in the center of the slotted wall section, ballast is placed at the lower edge of the sealing element with a centering device such as spacers. The connecting slot is made by vertical movement of a flushing lancet either in the interior of the connecting tube of the pre-existing slotted wall section or in the support suspension of the slotted wall section being formed.

DETAILED DESCRIPTION

Figure 1:
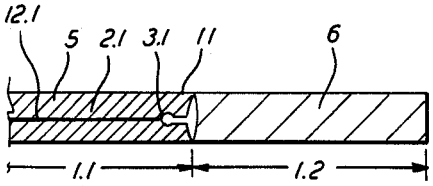
FIGS. 1 to 5 are a series of horizontal cross sectional views of vertically oriented slotted wall sections, showing a cycle of process steps for the fabrication of slotted walls with built-in thin-walled sealing elements, in accordance with the present invention.

FIG. 1 shows a slotted wall under construction at a point in time shortly before a placement of a sealing element 12.2 in the slotted wall section 1.2. The slotted wall section 1.2 is completely excavated and filled with a support suspension 6. A connecting slot 11 to the interior of a slotted connecting tube 3.1 at a vertical edge of an adjacent sealing element is flushed here and likewise filled with the support suspension 6. A slotted wall section 1.1 adjacent slotted wall section 1.2 is filled with hardening slotted wall mass 5 which had been prepared either by hardening of the support suspension 6 in slotted wall section 1.1 or by an exchange of a non-hardening support suspension 6 with a hardening slotted wall mass 4 and 5 (two-phase system). The thin-walled sealing element 12.1 of which the slotted connecting tube 3.1 is a part includes a foil 2.1 and another connecting tube at a vertical foil edge opposite the connecting tube 3.1. The slotted wall section 1.2 overlaps the already fabricated slotted wall section 1.1 by about 10 to 20 cm. The left-hand end face of the slotted wall section 1.2 is exemplarily spaced 0.30 m from the slotted connecting tube 3.1 in the slotted wall section 1.1, so that the previously installed sealing element 12.1 cannot be damaged during the excavation or milling of the slotted wall section 1.2.

Figure 2:
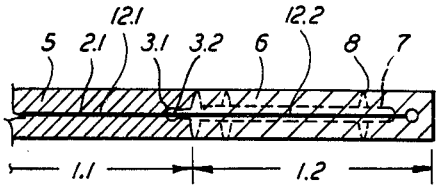

FIG. 2 schematically shows the placement of the sealing element 12.2 into the slotted wall section 1.2, which has been prepared as described above. For the installation of the sealing element, a ballast 7 is arranged at the lower edge of the sealing element 12.2. The ballast has spacers 8 which position the ballast 7 in the slot and, concomitantly, the sealing element 12.2, in a predetermined location in the slot. For example, the sealing element 12.2 can be maintained in a central location in the slotted wall. The slotted connecting tube 3.3 at one vertical edge of the sealing element 12.2 is spaced a distance of approximately 0.5 m from the leading end face of the leading slotted wall section as defined by the direction of the advance or construction. Placement of the sealing element 12.2 into slotted wall section 1.2 is effectuated in part by introducing a plug connection 3.2 into slotted connecting tube 3.1 of sealing element 12.1 of slotted wall section 1.1.

Figure 3:
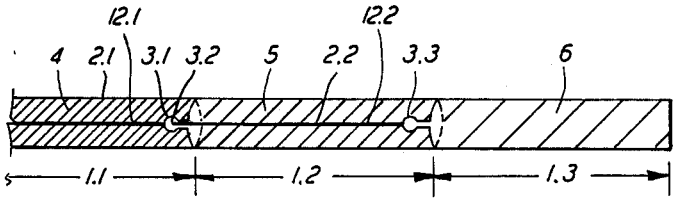

After placing the sealing element 12.2 into the slotted wall section 1.2, the support suspension 6 is either exchanged for a hardening slotted wall mass or it hardens to form the slotted wall mass 5, as shown in FIG. 3. After the hardening slotted wall mass 5 is sufficiently strong, the adjacent slotted wall section 1.3 can be excavated or milled with about 0.10 to 0.20 m overlap width. In the meantime, the slotted wall mass 5 in the slotted wall section 1.1 continues to harden and becomes the hardened slotted wall mass 4.

Figure 4:
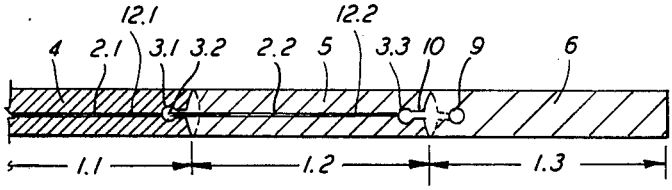

FIG. 4 shows the fabrication of the connecting slot 11, starting from the interior of the newly made slotted wall secton 1.3, through the partially hardened slotted wall mass 5 at the previously formed slotted wall section 1.2 into the interior of the slotted connecting tube 3.3. The connecting slot 11 is, for example, 10 cm wide, is made by means of a flushing device, advantageously a high pressure lancet 9. To this end, the lancet 9 is moved vertically in the support suspension 6 in the slotted wall section 1.3 and a high-pressure jet 10 is produced in the direction of the slotted connecting tube 3.3. The jet pressure and velocity are adjusted, depending on the strength of the hardening slotted wall mass 5 in slotted wall section 1.2 in such a manner that the connecting slot 11 and the interior of the slotted connecting tube 3.3 can be flushed clear. Advantageously a mixture of water and bentonite or of water, bentonite and a solidification agent can be used to form the high pressure jet 10. However, the use of pure water with or without abrasive additives such as fine-grain sand or the like is also suitable. Depending on whether the slotted walls are fabricated by means of the one- or two-phase system, a jet composition is also conceivable which corresponds to the support suspension 6.

Figure 5:
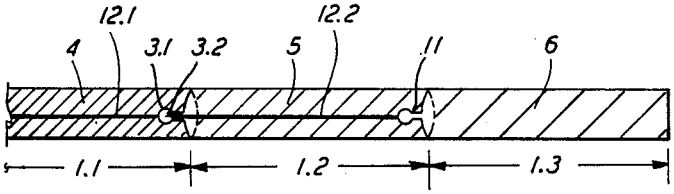

After the connecting slot 11 and the interior of the slotted connecting tube are flushed out, both are filled with the support suspension 6 in preparation for receiving a sealng element as shown in FIG. 5. FIG. 5 corresponds to FIG. 1, only advanced by one slotted wall section. The fabrication steps are then repeated in the sequence shown in FIGS. 1 to 5.

Figure 6:
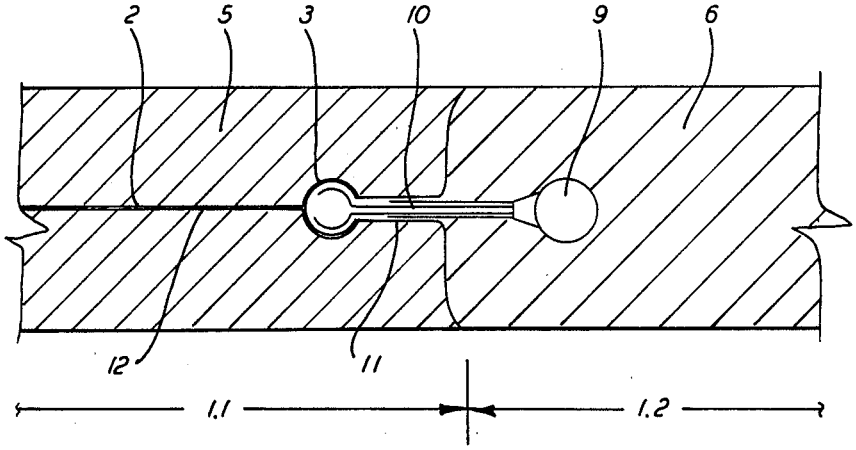
FIGS. 6 is a horizontal cross section on an enlarged scale, showing a connecting slot in accordance with the present invention.

FIG. 6 shows in detail the connecting slot 11 between the slotted wall section 1.2 and the interior of the slotted connecting tube 3. Both the slot and the tube are filled with the support suspension 6. The jet 10 ejected by the high pressure lancet 9 can contain solidification agents for the composition of the support suspension 6 such as cement. Thus, the suspension 6 can remain as the final hardened slotted wall mass 5 in the slotted wall without the need to exchange it.

In another advantageous solution for fabricating the connecting slot 11, not illustrated in the drawing, the connecting slot 11 is made by a vertical movement of the flushing lancet 9 in the interior of the slotted connecting tube 3 which also loosens and transports the material from the interior of the slotted connecting tube 3.

What is claimed is:

1. A method for fabricating a vertical barrier in the soil, comprising the steps of:

excavating in the soil a hole in the form of a first vertically oriented slot, said slot being contiguous with a previously formed slotted wall section;

forming a second vertically oriented slot of smaller width than said first vertically oriented slot and extending therefrom through a hardening wall mass of said previously formed slotted wall section to a slotted connecting tube attached along a vertical edge of a first planar sealing element disposed in said hardening wall mass of said previously formed slotted wall section;

filling said first and said second vertically oriented slot with a support suspension;

placing a second planar sealing element into the suspension in said first and said second vertically oriented slot, said step of placing including the step of introducing a plug connection disposed along a vertical edge of said second planar sealing element into said slotted connecting tube; and forming a hardened wall mass in said first vertically oriented slot.

2. The method defined in claim 1 wherein said step of forming said second vertically oriented slot comprises the step of flushing out a portion of said hardening wall mass.

3. The method defined in claim 2 wherein said step of flushing includes the step of moving a flushing lancet in a vertical direction.

4. The method defined in claim 3 wherein said flushing lancet is moved vertically in said connecting tube and is operated to eject a jet towards said first vertically oriented slot.

5. The method defined in claim 3 wherein said flushing lancet is moved vertically in said first vertically oriented slot at an end thereof proximate to said previously formed slotted wall section and wherein said flushing lancet is operated to eject a jet towards said connecting tube.

6. The method defined in claim 3 wherein said flushing lancet is operated to eject a high-pressure jet of a suspension of water, bentonite and at least one solidification agent.

7. The method defined in claim 3 wherein said flushing lancet is operated to eject a high-pressure jet of a suspension having the same composition as said support suspension.

8. The method defined in claim 1 wherein said step of placing includes the steps of attaching a ballast to a lower edge of said second planar sealing element.

9. The method defined in claim 8 wherein said step of placing further includes the step of centering said second planar sealing element between longitudinally extending vertical faces of said first vertically oriented slot.

10. The method defined in claim 1 wherein said step of forming a hardened wall mass in said first vertically oriented slot includes the step of hardening said support suspension in said first vertically oriented slot.

11. The method defined in claim 10 wherein said step of hardening includes the step of adding a solidification agent to said support suspension.

12. The method defined in claim 1 wherein said step of forming a hardened wall mass in said vertically oriented slot includes the step of exchanging said support suspension in said slot for a hardening wall mass.

13. The method defined in claim 1 wherein said support suspension is placed into said first vertically oriented slot prior to said step of forming said second vertically oriented slot.

* * * * *